US011132944B2

(12) United States Patent
Cook

(10) Patent No.: US 11,132,944 B2
(45) Date of Patent: Sep. 28, 2021

(54) UNBIASED ITERATIVE COMPRESSION ON ADDITIVE DATA USING DITHER

(71) Applicant: Samsung Display Co., Ltd., Yongin-si (KR)

(72) Inventor: Gregory W. Cook, San Jose, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 61 days.

(21) Appl. No.: 16/657,766

(22) Filed: Oct. 18, 2019

(65) Prior Publication Data

US 2021/0082341 A1 Mar. 18, 2021

Related U.S. Application Data

(60) Provisional application No. 62/902,284, filed on Sep. 18, 2019.

(51) Int. Cl.
*G09G 3/3208* (2016.01)
*G09G 3/20* (2006.01)

(52) U.S. Cl.
CPC ..... *G09G 3/3208* (2013.01); *G09G 3/2044* (2013.01); *G09G 2320/0257* (2013.01); *G09G 2320/043* (2013.01)

(58) Field of Classification Search
CPC ..... G09G 3/3208; G09G 3/2044; G09G 2320/0257; G09G 2320/043
See application file for complete search history.

(56) References Cited

U.S. PATENT DOCUMENTS

| | | | | |
|---|---|---|---|---|
| 5,742,892 | A | 4/1998 | Chaddha | |
| 6,195,128 | B1 | 2/2001 | Streater | |
| 7,590,299 | B2 | 9/2009 | Brown Elliott et al. | |
| 7,911,487 | B2 | 3/2011 | Brown Elliott et al. | |
| 8,022,908 | B2 | 9/2011 | Mizukoshi et al. | |
| 8,576,907 | B2 | 11/2013 | Demos et al. | |
| 8,670,625 | B2 | 3/2014 | Sasai et al. | |
| 8,879,857 | B2 | 11/2014 | Raveendran et al. | |
| 9,392,292 | B2 | 7/2016 | Ku et al. | |
| 9,351,003 | B2 | 10/2016 | Cote et al. | |
| 9,589,496 | B2 * | 3/2017 | Lu | G06F 11/3003 |
| 9,799,257 | B2 | 10/2017 | Tian et al. | |
| 2002/0168111 | A1 * | 11/2002 | Latva-Aho | H04N 19/60 382/232 |

(Continued)

OTHER PUBLICATIONS

Li, Junhui. "Image quality recovery in binary ghost imaging by adding random noise to fight quantization caused image quality decline", "Optics Letters", Apr. 2017, The Optical Society, vol. 42 pp. 1-8. (Year: 2017).*

(Continued)

*Primary Examiner* — Terrell M Robinson
(74) *Attorney, Agent, or Firm* — Lewis Roca Rothgerber Christie LLP

(57) ABSTRACT

A method of stress compensation in a display device includes retrieving, by a decoder, compressed stress data that is quantized by a quantization value, decoding, by the decoder, the compressed stress data to generate decoded data, generating a dither value based on the quantization value, and adding the dither value to the decoded data to compensate for quantization of the compressed stress data.

20 Claims, 5 Drawing Sheets

(56) References Cited

U.S. PATENT DOCUMENTS

| | | | | |
|---|---|---|---|---|
| 2005/0276502 | A1* | 12/2005 | Brown Elliott | G06T 5/004 382/254 |
| 2007/0229480 | A1 | 10/2007 | Ookawara | |
| 2012/0327139 | A1 | 12/2012 | Margulis | |
| 2014/0098858 | A1 | 4/2014 | Demos et al. | |
| 2015/0062202 | A1 | 3/2015 | Lu | |
| 2015/0194096 | A1 | 7/2015 | Chung et al. | |
| 2017/0347098 | A1 | 11/2017 | Gilmutdinov et al. | |
| 2019/0221158 | A1 | 7/2019 | An | |

OTHER PUBLICATIONS

Sullivan, Gary, J., et al., "Overview of the High Efficiency Video Coding (HEVC) Standard", IEEE Transactions on Circuits and Systems for Video Technology, vol. 22, No. 12, Dec. 2012, pp. 1649-1668.

EPO Extended Search Report dated, Apr. 15, 2019, for corresponding European Patent Application No. 19161985.7 (9 pages).

Akyol, Emrah et al., "On Constrained Randomized Quantization," 2012 Data Compression Conference, IEEE, Apr. 2012, pp. 72-81.

EPO Extended Search Report dated Nov. 24, 2020, for corresponding European Patent Application No. 20188251.1 (17 pages).

* cited by examiner

UNBIASED ITERATIVE COMPRESSION ON ADDITIVE DATA USING DITHER

CROSS-REFERENCE TO RELATED APPLICATION(S)

The present application claims priority to and the benefit of U.S. Provisional Patent Application Ser. No. 62/902,284, filed Sep. 18, 2019 and entitled "UNBIASED ITERATIVE COMPRESSION ON ADDITIVE DATA USING DITHER," the entire content of which is hereby expressly incorporated by reference.

The present application is also related to U.S. patent application Ser. No. 15/979,279, filed May 14, 2018 and entitled "STRESS PROFILE COMPRESSION," which claims priority to and the benefit of U.S. Provisional Patent Application Ser. No. 62/643,622, filed Mar. 15, 2018 and entitled "STRESS PROFILE COMPRESSION," the entire contents of which are hereby expressly incorporated by reference.

FIELD

Aspects of the present disclosure relate to stress compensation or image sticking or ghosting effect in a display device.

BACKGROUND

Compensation for output decline in a video display such as an organic light-emitting diode (OLED) display may be used to preserve image quality as a display ages. The data used to perform such compensation may be stored in compressed form to reduce memory requirements; however, errors in such compressed data may accumulate unevenly, resulting in loss of image quality.

Additionally, when an OLED display device displays a static image for a prolonged period of time, it may suffer from image retention. The result is that once the static image is removed or changed, a faint outline—or ghosting—of the original image may still be visible to a user, even when the image content has changed. This is often referred to as image sticking, image retention, or image ghosting. The same method as stress profile is applied for image sticking.

Thus, there is a need for an improved system and method for stress compensation to reduce or eliminate output decline of OLED display devices.

The above information disclosed in this Background section is only for enhancement of understanding of the background of the disclosure and therefore it may contain information that does not constitute prior art.

SUMMARY

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

Aspects of example embodiments of the present disclosure relate to a system and a method for reducing or eliminating display output decline by mitigating the effects of pixel degradation/aging in a display device.

Aspects of example embodiments of the present disclosure relate to a system and method utilizing dither to compensate for quantization noise in iterative compression on additive data.

According to some embodiments of the present disclosure, there is provided a method of stress compensation in a display device, the method including: retrieving, by a decoder, compressed stress data that is quantized by a quantization value; decoding, by the decoder, the compressed stress data to generate decoded data; generating a dither value based on the quantization value; and adding the dither value to the decoded data to compensate for quantization of the compressed stress data.

In some embodiments, the generating and the adding are performed by the decoder or a circuit external to the decoder.

In some embodiments, the quantization value is a power of two, the quantization value is stored in a header of the compressed stress data, and the compressed stress data corresponds to brightness values of a slice of a frame of pixel data to be displayed on a display device.

In some embodiments, the generating the dither value is further based on a previous dither value corresponding to the compressed stress data, wherein the previous dither value is stored in a header of the compressed stress data.

In some embodiments, the generating the dither value includes utilizing a uniform pseudo-random number generator.

In some embodiments, the generating the dither value includes: determining, by the decoder, that the quantization value is equal to 1; and in response, outputting, by the decoder, the dither value as zero.

In some embodiments, the generating the dither value includes: determining, by the decoder, that the quantization value is equal to 2; and in response, outputting, by the decoder, the dither value as equaling a modulus of a previous dither value plus one and the quantization value.

In some embodiments, the generating the dither value includes: outputting, by the decoder, the dither value as equaling a modulus of a first value and the quantization value, wherein the first value is calculated as an addition of a previous dither value and half of the quantization value subtracted by one.

In some embodiments, the method of further includes: storing, by the decoder, the dither value in a header of the decoded data.

According to some embodiments of the present disclosure, there is provided a method of stress compensation in a display device, the method including: compressing, by an encoder, a first accumulated stress data at a quantization corresponding to a quantization value to generate compressed accumulated stress data; storing, by the encoder, the compressed accumulated stress data in a memory; retrieving and decompressing, by a decoder, the compressed accumulated stress data to generate decoded data; generating, by the decoder, a dither value based on the quantization value; and adding, by the decoder, the dither value to the decoded data to compensate for the quantization of the first accumulated stress data.

In some embodiments, the method further includes: receiving, by a stress capture module, an output image to be displayed on the display device; and calculating, by the stress capture module, second stress data based on the output image.

In some embodiments, the method further includes: receiving, by an adding circuit, second stress data corresponding to a frame of image data to be displayed on the display device; and adding, by the adding circuit, the decoded data to the second stress data to generate an updated accumulated stress data.

In some embodiments, the method further includes: compressing, by the encoder, the updated accumulated stress data for storage in the memory.

In some embodiments, the generating the dither value is further based on a previous dither value corresponding to the first accumulated stress data, and wherein the previous dither value corresponds to a slice of a frame of pixel data different from a slice of the frame of pixel data corresponding to the second stress data.

In some embodiments, the first accumulated stress data corresponds to brightness values of a slice of a frame of pixel data to be displayed on a display device.

In some embodiments, the generating the dither value is further based on a previous dither value corresponding to the first accumulated stress data, and wherein the quantization value and the previous dither value are stored in a header of the compressed accumulated stress data.

In some embodiments, the generating the dither value includes: determining, by the decoder, the quantization value; in response to determining that the quantization value is equal to 1, outputting, by the decoder, the dither value as zero; and in response to determining that the quantization value is equal to 2, outputting, by the decoder, the dither value as equaling a modulus of a previous dither value plus one and the quantization value.

In some embodiments, the generating the dither value includes: outputting, by the decoder, the dither value as equaling a modulus of a first value and the quantization value, and wherein the first value is calculated as an addition of a previous dither value and half of the quantization value subtracted by one.

In some embodiments, the method further includes: storing, by the decoder, the dither value in a header of the decoded data.

According to some embodiments of the present disclosure, there is provided a system for performing stress compensation in a display device, the system including: a memory; and a processing circuit configured to perform: retrieving compressed stress data that is quantized by a quantization value; decoding the compressed stress data to generate decoded data; generating a dither value based on the quantization value; and adding the dither value to the decoded data to compensate for quantization of the compressed stress data.

BRIEF DESCRIPTION OF THE DRAWINGS

These and other features of some example embodiments of the present disclosure will be appreciated and understood with reference to the specification, claims, and appended drawings, wherein:

DETAILED DESCRIPTION

Figure 1:
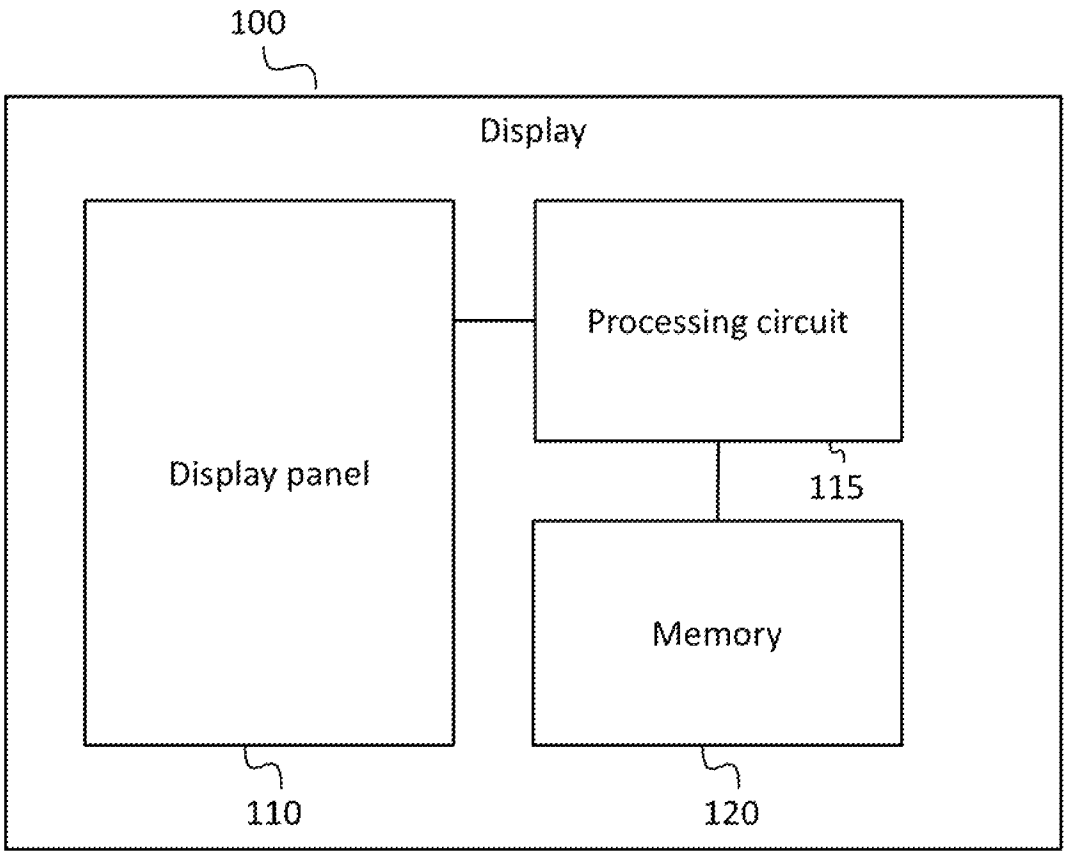
FIG. 1 illustrates an example embodiment of a display device, according to some example embodiments of the present disclosure.

The detailed description set forth below in connection with the appended drawings is intended as a description of some example embodiments of a system and a method for mitigating the effects of compression errors provided in accordance with the present disclosure and is not intended to represent the only forms in which the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the scope of the disclosure. As denoted elsewhere herein, like element numbers are intended to indicate like elements or features.

Certain kinds of display devices may have characteristics that change with use. For example, an organic light-emitting diode (OLED) display device may include a display panel having a plurality of pixels, each including several subpixels (e.g., a red subpixel, a green subpixel, and a blue subpixel), and each of the subpixels may include an organic light-emitting diode configured to emit a different respective color. Each organic light-emitting diode may have an optical efficiency that declines with use, so that, for example, after the organic light-emitting diode has been in operation for some time, the optical output at a certain current may be lower than it was, at the same current, when the organic light-emitting diode was new.

This reduction in optical efficiency may result in dimming of parts of a display panel that have on average, during the life of the display device, displayed brighter portions of the displayed images than other parts of the display. For example, a display device used to view largely unchanging images from a security camera, the field of view of which contains a scene having a first portion that is sunlit, and relatively bright, during most of the day, and a second portion that is in the shade and relatively dim, during most of the day, may eventually show a more significant decrease in optical efficiency in the first portion than in the second portion. The fidelity of image reproduction of such a display device may degrade over time as a result. As another example, a display device that is used part of the time to display white text at the bottom of the image, separated by a black margin from the rest of the image, may experience a lower reduction of optical efficiency in the black margin than in other parts of the display panel, so that if the display device is later used in a mode in which a scene fills the entire display panel, a brighter band may appear where the black margin was previously displayed. This may be referred to as image sticking or ghosting.

To reduce the effect of such non-uniformities in the optical efficiency of a display device, a display device may include features to compensate for the reduction of optical efficiency resulting from use of the display.

FIG. 1 illustrates an example embodiment of a display device 100, according to some example embodiments of the present disclosure.

Referring to FIG. 1, the display device 100 may include a display panel 110, a processing circuit 115 (e.g., a processor or a central processing unit (CPU)), and a memory 120. The memory 120 includes data that may be referred to as a "stress profile" or "stress table" for the display device 100. The "stress profile" or "stress table" stored on the memory 120 may be a table of numbers or "stress values" indicating the amount of stress each sub-pixel in the display device 100 has been subjected to during the life of the display device 100. The "stress" may be the total (e.g., time-integrated) drive current that has flowed through each sub-pixel during the life of the display device 100 or sum total of the brightness values displayed. For example, the "stress" may be the total charge that has flowed through each sub-pixel during the life of the display device 100.

In some example embodiments, the method of determining the "stress profile" may be a data driven method to compensate for OLED output decline. In some example embodiments, in order to determine the "stress profile" of the display device 100, the memory 120 may accumulate one number for one or some sub-pixels, each time a new image is displayed in the display device 100 as a new entry in the "stress profile" or "stress table" for the display device 100. For example, as a continuous stream of images together form displayed video in the display device 100, the drive current for each sub-pixel in each image may be measured and a number indicating the current or brightness of the subpixel may be added to the respective number or "stress" for that sub-pixel in "stress profile" or stress table" in the memory 120. In some examples, the stress value for each sub-pixel may be calculated as the total sum of the brightness values displayed by the sub-pixel.

In some example embodiments, a display device 100 includes a timing controller and a plurality of driver integrated circuits (e.g., a scan/gate driver and a data driver). The processing circuit 115 may be, or may be part of, one or more of the driver integrated circuits. In some embodiments, each driver integrated circuit is responsible for driving a portion of the display panel 110, and it may accordingly perform stress accumulation and stress compensation for that portion, independently of the other driver integrated circuits.

In some example embodiments, during operation of the display device 100, the drive current to each sub-pixel may be adjusted to compensate for an estimated loss of optical efficiency. The estimated loss of optical efficiency may be based on the lifetime stress of the sub-pixel. For example, the drive current to each sub-pixel may be increased in accordance with (e.g., in proportion to) the estimated loss of optical efficiency of the sub-pixel (e.g., as accumulated in the memory 120), so that the optical output of the sub-pixel may be substantially the same as it would have been had the optical efficiency of the sub-pixel not been reduced, and had the drive current not been increased. In some example embodiments, a non-linear function based on empirical data or a model of the physics of the sub-pixel may be used to infer or predict the loss of optical efficiency expected to be present, based on the lifetime stress of the sub-pixel. The calculations of the predicted loss of optical efficiency, and of the accordingly adjusted drive current, may be performed by the processing circuit 115. In some embodiments, the calculations are stored in a look up table in the memory and the processing circuit 115 may use it for compensation. In some example embodiments, during operation of the display device 100, the drive current to each sub-pixel may be adjusted according to a compensation factor, which may be calculated based on an accumulated brightness captured from output image of the sub-pixel.

Figure 2:
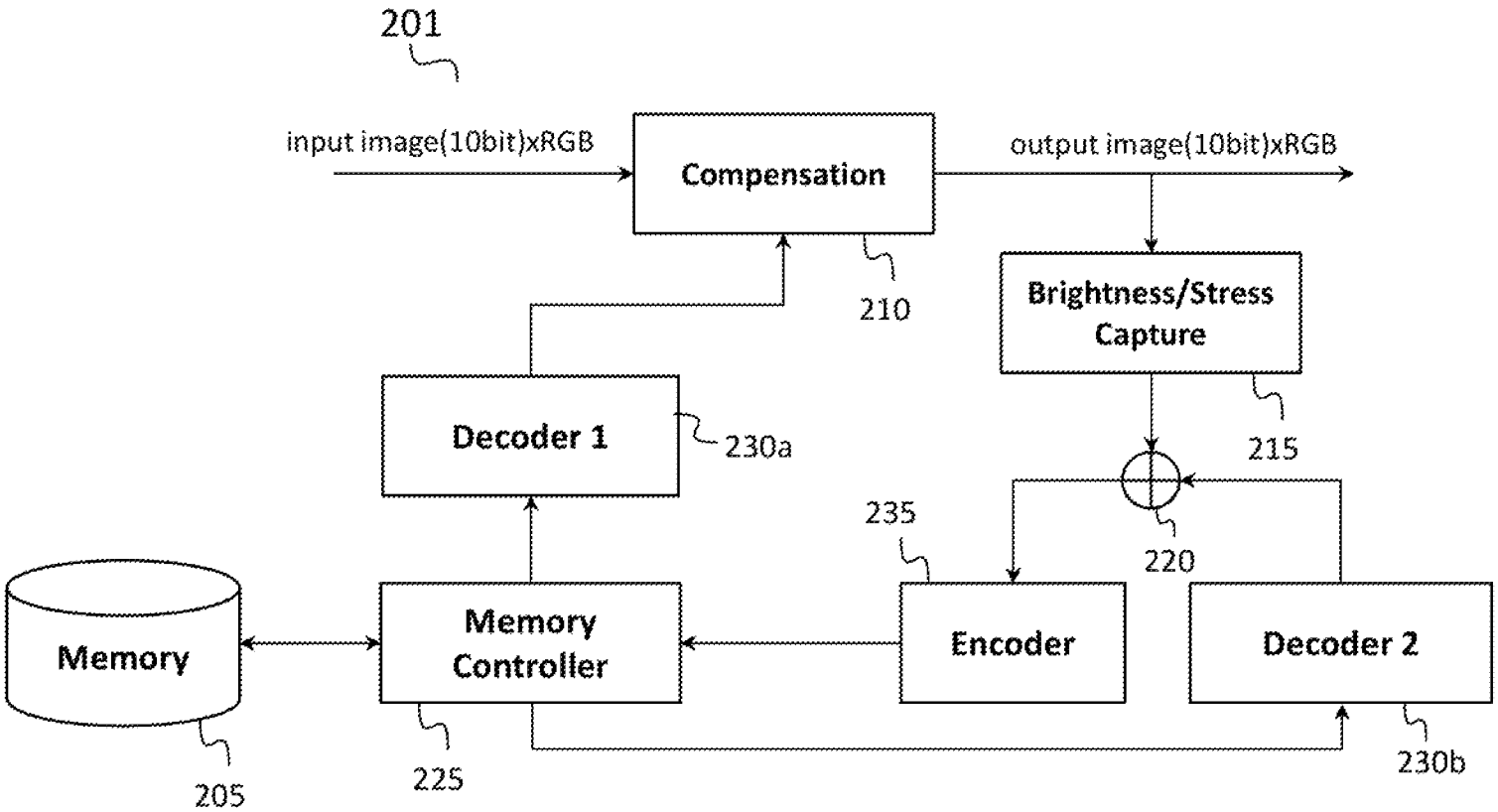
FIG. 2 illustrates a block diagram of a system for stress compensation, according to some embodiments of the present disclosure.

FIG. 2 illustrates a block diagram of a system 200 for stress compensation, according to some embodiments of the present disclosure. The system 200 includes a memory 205 (which may be the same as, or be a part of, the memory 120), a compensation module 210, a stress capture module 215, an adding circuit 220, and a memory controller 225. The stress table is stored in the memory 205. In operation, stress values in the stress table may be accessed (e.g., read out) via the memory controller 225 and may be used by the compensation module 210 to determine compensation factors for the sub-pixels. The compensation module 210 may include a drive current adjustment circuit to calculate adjusted drive current values for each sub-pixel based on the respective compensation factor of that sub-pixel. The compensation factor for each sub-pixel is based on the stress value of that sub-pixel. In some example embodiments, the adjusted drive current value for each sub-pixel may be a raw drive current value (e.g., based on the desired optical output of the sub-pixel), adjusted according to the accumulated stress of the sub-pixel. The adjusted drive current value for each sub-pixel is read by the stress capture module 215, which may include a sub-pixel stress sampling circuit. The adjusted drive current value for each sub-pixel represents the current rate of accumulation of stress of the sub-pixels being displayed. Each previously stored (e.g., in the memory 205) stress value for each sub-pixel is increased (or "augmented") in an adding circuit 220 based on the current rate of accumulation of stress (e.g., by a number proportional to the adjusted drive current value), and saved back to the memory 205 via the memory controller 225. The memory controller 225 controls read and write operations in the memory 205 and feeds the stress values from the memory 205 to the drive current adjustment circuit of the compensation module 210 and to the adding circuit 220 as needed. The memory controller 225 also stores the augmented stress values, which have been augmented by the addition of the current rate of accumulation of stress at the adding circuit 220, back into memory 205.

In some example embodiments, tracking the total stress of each sub-pixel may require a significant amount of memory. For example, for a display with 1920×1080 pixels, with three sub-pixels per pixel, and with the stress of each sub-pixel stored in a few byte numbers, the size of the memory required may be in the order of tens of megabytes. Moreover, the computational burden of updating each stress number for each sub-pixel for each frame of video (e.g., for each displayed image) is significant.

Various approaches may also be used to reduce the memory size required for storing sub-pixel stress in the stress table. In some embodiments, the memory on the stress profile chipset is reduced by compressing the data stored in the memory.

According to some embodiments, the system 200 also includes a first decoder 230*a*, an encoder 235, and a second decoder 230*b*. In some example embodiments, a compressed representation of the stress table is stored in the memory 205. In operation, compressed stress data may be accessed (e.g., read out) via the memory controller 225 and may be decompressed by the first decoder 230*a* before being fed to the drive current adjustment circuit of the compensation module 210. The drive current adjustment circuit of the compensation module 210 calculates the adjusted drive current values for each sub-pixel based on the respective compensation factor of that sub-pixel. The compensation factor for each sub-pixel is based on the stress value of that sub-pixel. The adjusted drive current value for each sub-pixel is read by the stress capture module 215. The adjusted drive current value for each sub-pixel represents the current rate of accumulation of stress of the sub-pixels being displayed. The compressed stress data in the memory 205 are also decompressed by a second decoder 230*b* to retrieve each previously stored (e.g., in the memory 205) stress value for each sub-pixel. The decompressed stress values for the sub-pixel from the second decoder 230*b* are sent to the adding circuit 220. Each previously stored stress value for each sub-pixel is increased (or "augmented") in the adding circuit 220 based on the current rate of accumulation of stress (e.g., by a number proportional to the adjusted drive current value). The augmented stress values from the adding circuit 220 are compressed by the encoder 235, before being stored in the memory 205. The encoder 235 compresses data that it receives in a manner that reduces the size of the stored data. In some examples, the compression applied by the compressor may be lossy, in order to reduce (e.g., minimize) the amount of memory capacity consumed by the compressed data. Each of the first decoder 230*a* and the second decoder 230*b* decompresses the received data. For example, each of the first decoder 230*a* and the second decoder 230*b* performs an operation that inverts, or approximately inverts, the operation performed by the encoder 235. Various methods of compression may be employed, including entropy coding, such as Huffman coding or arithmetic coding.

In some examples, the output of first decoder 230*a* may be truncated so as to discard the lesser significant bits of the decoded value. This may be done due to the fact that while the lesser significant bits serve to accurately measure the accumulated stress, they may not materially affect the compensation performed by the compensation module 210.

According to some embodiments, the encoder and decoders operate on a unit of data referred to as a slice. The slice is an independent coding unit of image data that represents a portion of the image. For example, the slice may be a portion that spans the entire width and four vertical lines of the image. Each iteration of the encoding/decoding process described above may be performed on one slice of the image data.

While the first and second decoders 230*a* and 230*b* have been illustrated in FIG. 2 as being two separate circuits, embodiments of the present disclosure are not limited thereto. For example, the two decoders 230*a* and 230*b* may be combined into one decoder circuit. In some examples, the second decoder 230*b* may be omitted and the output of the first decoder 230*a* may be provided to the adding circuit 220. Hereinafter, the combination of the encoder, the adding circuit, and the one or more decoders is referred to as a "codec device".

The system 200 of FIG. 2 may reduce the memory size required for storing sub-pixel stress in the stress table. However, due to the iterative nature of the system, errors can accumulate in the memory or the stress table, as compared to a system that does not use compression. The iterative additive nature of the stress profile may cause the compression and decompression errors to accumulate from one iteration to the next. Thus, unless carefully controlled, the compression error, which may be quantization error, can accumulate and can result in significant compensation factor errors for some parts of the image. Some embodiments of the present disclosure compensate for the accumulation of error by utilizing a particular dither at the decoder 230*a*/230*b*.

Figure 3A:
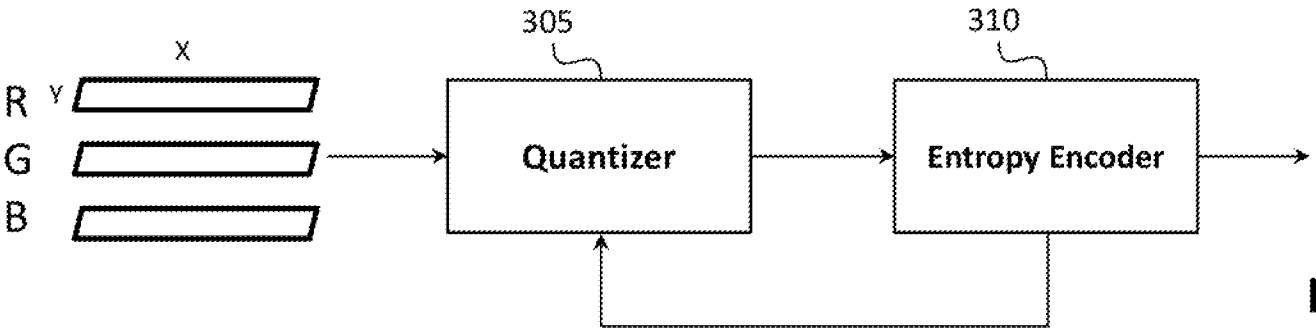
FIG. 3A illustrates a block diagram of the encoder, according to some example embodiments of the present disclosure.
Figure 3B:
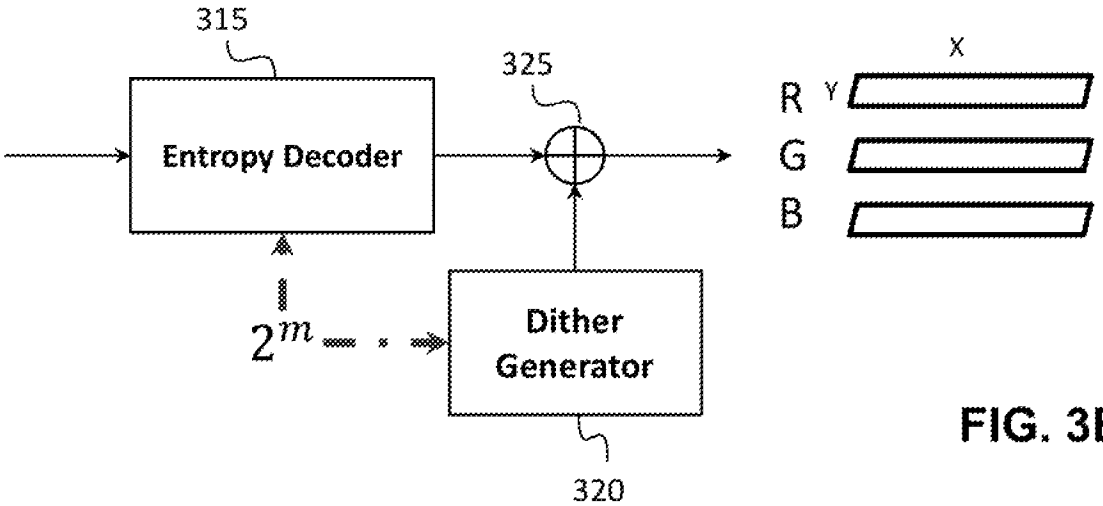
FIG. 3B illustrates a block diagram of decoder, according to some example embodiments of the present disclosure.

FIG. 3A illustrates a block diagram of the encoder 235, according to some example embodiments of the present disclosure. FIG. 3B illustrates a block diagram of decoder 230, according to some example embodiments of the present disclosure. The decoder 230 of FIG. 3A may be the same or substantially the same as the first decoder 230 and/or the second decoder 230*b* of FIG. 2.

Referring to FIG. 3A, according to some embodiments, the encoder 235 includes a quantizer 305 and an entropy encoder 310. The quantizer 305 may be a uniform quantizer with exponential quantization, and may have the effect of zeroing out m (a positive integer) least significant bits of an input value, and thus removing m bits from the bit line. Thus, the operation of the quantizer 305 is inherently lossy. Here, the input value may be accumulated stress data for a slice of one frame of image data/pixel values received from the stress capture module 215. The entropy encoder 310 may include any lossless encoding, such as arithmetic encoding, Huffman encoding, and/or the like. The entropy encoder may also include median adaptive prediction. The quantization operation allows full control over the amount of loss in the system prior to encoding. For example, the value of m allows the encoder to control the amount of error resulting from the encoding operation of the encoder 235. In some examples, the encoder 235 may determine the exponential quantization parameter m through an iterative process. For example, the value m may initially be set to a first value (e.g., 1) and incremented until a desired compression ratio (e.g., a 4 to 1 compression ratio) is achieved by the encoder 235. According to some embodiments, the resulting value of m is stored (e.g., saved in the header of the encoded data) for later use by the decoder 230.

In some embodiments, the decoder 230 includes an entropy decoder 315, a dither generator 320, and an adder 325. The entropy decoder 315 may be a lossless decoder (e.g., an arithmetic or Huffman decoder) that performs the inverse operation of the entropy encoder 310. In some embodiments, the entropy decoder 315 includes a scaler configured to multiply its input by $2^m$, which is the quantization value utilized by the encoder 235. The adder 335 adds the outputs of the entropy decoder 315 and the dither generator 320.

In effect, the combined operation of the quantizer 305 and the scaler may be formulaically expressed by Equation (1):

$$q'_m(x) = \left\lfloor \frac{x}{2^m} \right\rfloor 2^m \qquad \text{Equation (1)}$$

where x represents an input value, such as the retrieved stress value, m represents the exponential quantization parameter, $$\left\lfloor \frac{x}{2^m} \right\rfloor$$

represents the bit operation performed by the quantizer 305 of the encoder 235, the multiplication by $2^m$ is performed by the scaler of the decoder 230, and $q'_m(x)$ represents the quantized value of x.

The quantization and scaling operations have the property that can be expressed by Equation 2:

$$q'_m(q'_m(x)) = q'_m(x) \qquad \text{Equation (2)}$$

In other words, consecutive iterations of the application of the quantization and scaling does not add further error. That is, the codec device is idempotent (i.e., successive operation of the decoder-encoder operations does not change the results beyond the initial application) or substantially idempotent.

According to some embodiments, the dither generator 320 generates and outputs a dither (e.g., a quantized-constrained dither) that is added to the output of the entropy decoder 315 via the adder 325. The dither may be a uniform dither calculated based on the quantization value $n=2^m$. The dither values may be $\{0, 1 \ldots n-1\}$. As will be described below, due to the nature of the encoding algorithm, the added dither results in unbiased addition of stress values (i.e., an addition that does not accumulate quantization error).

In some embodiments, the same dither value is added to the decompressed stress values of all of the pixels in the same slice. This ensures that additional entropy is not introduced through the next addition operation of the next iteration of the codec device. This is because the added dither is more useful temporally (per iteration) rather than spatially. If the dither were different spatially for different pixels, it would unnecessarily introduce additional noise which is more difficult to compress. For example, if different dither values are used within the same slice, brightness values of pixels in a flat area may not be the same after further addition and quantizing. In some examples, the dither varies slice to slice, even for the same quantization value, as each slice is treated independently and the start of the dither sequence is based on when the quantization changes and is independent from the other slices. In effect, the dither allows the codec to effectively subsample the addition performed by the adding circuit 220 while maintaining unbiased estimation. This can be mathematically illustrated as follows.

It can also be shown that where $$q_n(x) = \left\lfloor \frac{x}{n} \right\rfloor n:$$

$$E[q_n(X+c)]=c \qquad \text{Equation (3)}$$

where n is the quantization value $2^m$, c is a non-negative integer representing the stress value of a single subpixel (e.g., a red, green, or blue subpixel of a pixel) for a given iteration calculated by the stress capture module 215, X is a random variable between 0 and (n−1) representing the dither value, and $E[q_n(X+c)]$ is the expected value of the quantized stress value, which may be stored at the memory 205. As an example, if the quantization value n is equal to 4, and c is equal to 1, without the dither (i.e., without the random variable X), the expected value described by Equation (3) is 0; however, with dither, the expected value is c=1. In other words, with the dither added, the expected value of the quantized/compressed stress value being stored in memory is the same as the uncompressed stress value.

Further, it can be shown that:

$$E[q_{n_i}(X_{n_i}+c_i+q_{n_{i-1}}(X_{n_{i-1}}+c_{i-1}))]=c_i+c_{i-1} \qquad \text{Equation (4)}$$

where $X_{n_i}$ is a random value between 0 and $(n_i-1)$, i is natural number representing the current iteration, $n_i$ is a natural number greater than 1, $g_{n_{i-1}}(X_{n_{i-1}}+c_{i-1})$ represents the retrieved compressed value from the memory 205, $c_{i-1}$ is the captured stress value corresponding to the retrieved quantized stress value, $X_{n_{i-1}}$ is the previous dither value corresponding to the retrieved quantized stress value, $c_i$ is the newly added stress value from the stress capture 215, and $X_{n_i}$ is the new dither value.

Equation (4) is an expression of two the expected value of the stored stress value for two consecutive iterations. However, even when expanded to an arbitrary number of iterations, the overall conclusion still holds that the expected value of the compressed accumulated stress value, according to some embodiments, is the same as the accumulated value in uncompressed form. This is due to the application of the dither that is set based on the quantization value $2^m$. Thus, the added dither may compensate for the quantization effect of the encoder 235. As a result, the encoder 235 and decoder 230 combination may function as an unbiased estimator for compound addition of stress values.

In some examples, the encoder 235 may store the quantization value in the header of the encoded data and the decoder 230 may recover the dither value in the header of the decoded data. Thus, it may be unnecessary to keep track of the iteration number. In this manner, the decoder 230 can always identify the previous quantization and dither values, which the decoder 230 may use to determine the dither value in the current iteration.

According to some embodiments, when the decoder 230 determines that no quantization was applied in the previous iteration (e.g., determines that the exponential quantization parameter m=0 or that the quantization value $2^m=1$), the dither value is set to zero and no dither is applied to the encoded data. When the decoder 230 determines the quantization value equals 2 (i.e., m=1), the decoder 230 calculates the current dither value as modulus, or remainder after integer division of, the previous dither value plus one and the quantization value. Otherwise (i.e., m>1), the decoder 230 calculates the dither value as the modulus of the addition of the previous dither value and $2^{m-1}-1$ and the quantization value. While a slice of data may use a single dither value, it can be proven that by using a modulo additive value of $2^{m-1}-1$, all dither values will be used (over many iterations) for a given quantization value, as long as the quantization step doesn't change between iterations. If not all the values are used, it is possible that the result from the addition and quantization steps may be biased from the actual value over many iterations. In general, the dither sequence needs to only conform to a uniform pseudo random number sequence based on the quantization step size to support unbiased iterative addition. The above description is just one possible approximation which does not require extra information in the header to hold the state of the psuedo-random number (PRN) generator; and embodiments of the present invention are not limited thereto. For example, rather than "bouncing" around all of dither values, as done above, one may progress through the possible dither values in a linear fashion.

The calculation of the dither value based on the quantization value and the previous dither value (i.e., the dither value of the previous iteration), according to some embodiments, may also be expressed in pseudo code as:

```
quant_value = 2^m
if (m==0)        //no quantization has occurred
   dither = 0
else if (m==1)
   dither = (prev_dither + 1) % quant_value
else
dither = (prev_dither + 2^(m−1) − 1) % quant_value
prev_dither = dither
```

Thus, according to some embodiments, by using the quantization-constrained dither, the codec can compress/quantize the accumulated stress value data without additive bias. This also allows for the changes in quantization to dynamically match the memory requirements. The method and system, according to some embodiments of the present disclosure, may be readily implemented as it does not require knowledge of the output values of the decoder or the previous values input to the encoder.

Figure 4:
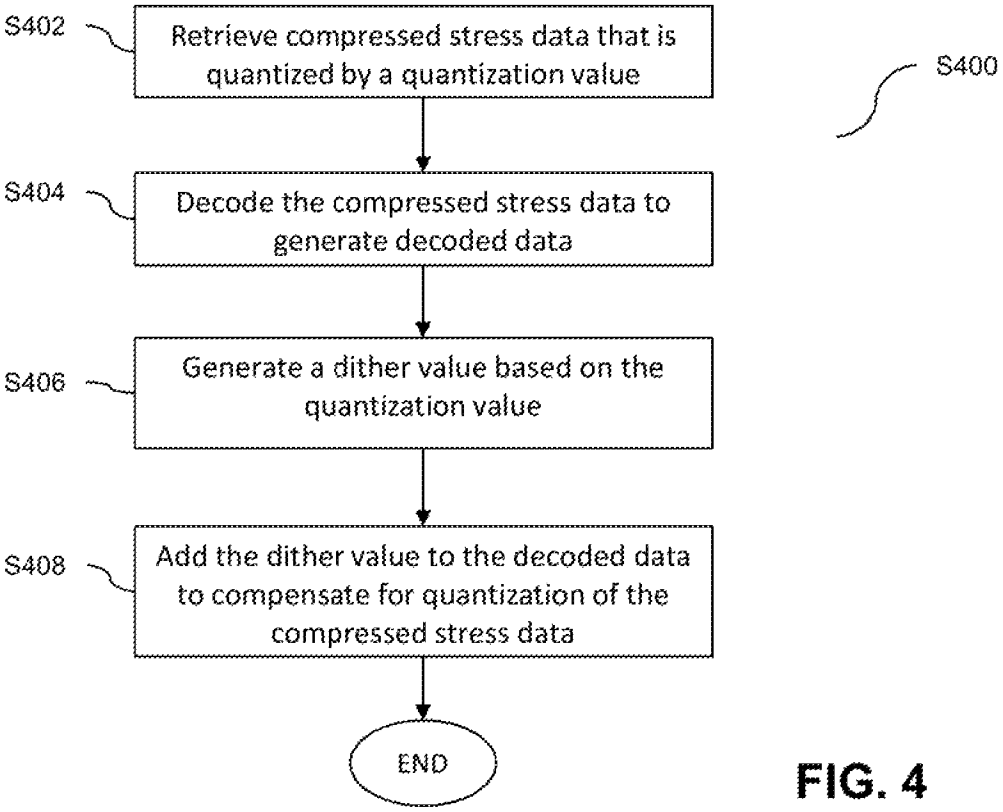
FIG. 4 illustrates a process of stress compensation via a decoder in a display device, according to some example embodiments of the present disclosure.

FIG. 4 illustrates a process S400 of stress compensation via a decoder 230 in a display device, according to some example embodiments of the present disclosure.

Referring to FIG. 4, according to some embodiments, the decoder 230 retrieves (S402) the compressed stress data that is quantized by a quantization value $2^m$ from memory 205. The decoder decodes the compressed stress data to generate decoded data (S404), and generates a dither value based on the quantization value (S406). In some embodiments, the generating the dither value is further based on a previous dither value, from a previous iteration, which corresponds to the compressed stress data. The previous dither value and the quantization value may be stored in the header compressed stress data. As such, there may be no need to keep track of the number of iterations the accumulated stress data has undergone. The generation of the dither value may be done by an approximation of a uniform random number generator (e.g., a uniform pseudo-random number generator) according to the previous dither value and the quantization value. In some embodiments, the decoder adds the dither value to the decoded data to compensate for quantization of the compressed stress data (S408).

Figure 5:
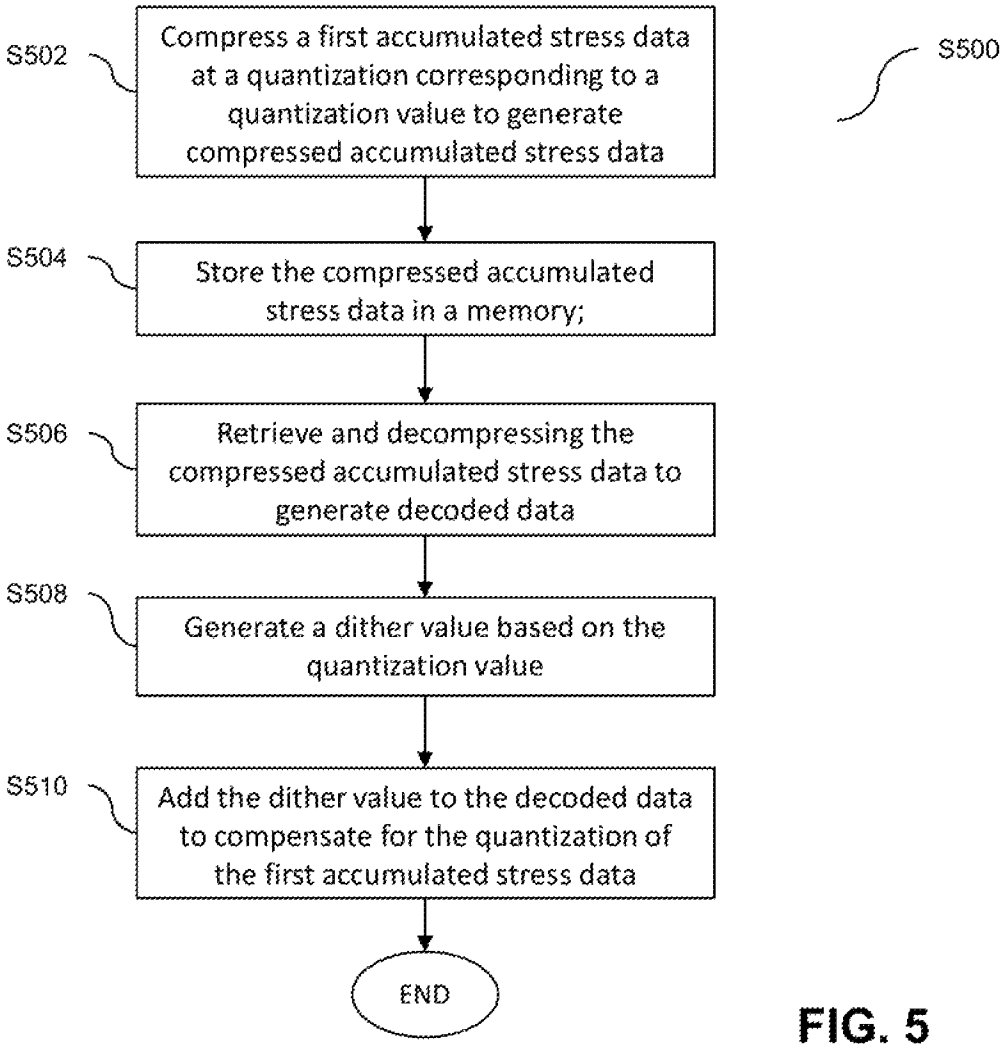
FIG. 5 illustrates a process of stress compensation in a display device, according to some example embodiments of the present disclosure.

FIG. 5 illustrates a process S500 of stress compensation in a display device, according to some example embodiments of the present disclosure.

Referring to FIG. 5, according to some embodiments, the encoder 235 compresses a first accumulated stress data at a quantization corresponding to a quantization value $2^m$ to generate compressed accumulated stress data (S502). The first accumulated stress data may correspond to brightness values of a slice of a frame of pixel data to be displayed on a display device 100. In some embodiments, the encoder stores the compressed accumulated stress data in the memory (S504). The decoder then retrieves and decompresses the compressed accumulated stress data to generate decoded data (S506). In some embodiments, the decoder generates a dither value based on the quantization value $2^m$ (S508) and adds the dither value to the decoded data to compensate for the quantization of the first accumulated stress data (S510). the generating of the dither value may be further based on a previous dither value from a previous iteration, which corresponds to the first accumulated stress data.

The stress capture module 215 may receive an output image to be displayed on the display device 100, and calculate second stress data based on the output image. The adding circuit 220 may receive the second stress data corresponding to a frame of image data to be displayed on the display device 100, and add the decoded data to the second stress data to generate an updated accumulated stress data. The encoder 235 may compress the updated accumulated stress data for storage in the memory 205. The previous dither value may be used in conjunction with a slice of a frame of pixel data that is different from a slice of the frame of pixel data corresponding to the second stress data.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present disclosure.

Although exemplary embodiments of a system and a method for mitigating the effects of compression errors have been specifically described and illustrated herein, many modifications and variations will be apparent to those skilled in the art. Accordingly, it is to be understood that to a system and a method for mitigating the effects of compression errors using stress profile compression constructed according to principles of this disclosure may be embodied other than as specifically described herein. The scope of the present disclosure is defined by the following claims, and equivalents thereof.

What is claimed is:

1. A method of stress compensation in a display device, the method comprising:

retrieving, by a decoder, compressed stress data that is quantized by a quantization value;

decoding, by the decoder, the compressed stress data to generate decoded data;

generating a dither value based on the quantization value of the compressed stress data; and adding the dither value to the decoded data to compensate for quantization of the compressed stress data.

2. The method of claim 1, wherein the generating and the adding are performed by the decoder or a circuit external to the decoder.

3. The method of claim 1, wherein the quantization value is a power of two, wherein the quantization value is stored in a header of the compressed stress data, and wherein the compressed stress data corresponds to brightness values of a slice of a frame of pixel data to be displayed on a display device.

4. The method of claim 1, wherein the generating the dither value is further based on a previous dither value corresponding to the compressed stress data, wherein the previous dither value is stored in a header of the compressed stress data, and wherein the generating the dither value comprises utilizing a uniform pseudo-random number generator.

5. The method of claim 1, wherein the generating the dither value comprises:

determining, by the decoder, that the quantization value is equal to 1; and in response, outputting, by the decoder, the dither value as zero.

6. The method of claim 1, wherein the generating the dither value comprises:

determining, by the decoder, that the quantization value is equal to 2; and in response, outputting, by the decoder, the dither value as equaling a modulus of a previous dither value plus one and the quantization value.

7. The method of claim 1, wherein the generating the dither value comprises:

outputting, by the decoder, the dither value as equaling a modulus of a first value and the quantization value, wherein the first value is calculated as an addition of a previous dither value and half of the quantization value subtracted by one.

8. The method of claim 1, further comprising:

storing, by the decoder, the dither value in a header of the decoded data.

9. A method of stress compensation in a display device, the method comprising:

compressing, by an encoder, a first accumulated stress data at a quantization corresponding to a quantization value to generate compressed accumulated stress data;

storing, by the encoder, the compressed accumulated stress data in a memory;

retrieving and decompressing, by a decoder, the compressed accumulated stress data to generate decoded data;

generating, by the decoder, a dither value based on the quantization value of the compressed accumulated stress data; and adding, by the decoder, the dither value to the decoded data to compensate for the quantization of the first accumulated stress data.

10. The method of claim 9, further comprising:

receiving, by a stress capture module, an output image to be displayed on the display device; and calculating, by the stress capture module, second stress data based on the output image.

11. The method of claim 9, further comprising:

receiving, by an adding circuit, second stress data corresponding to a frame of image data to be displayed on the display device; and adding, by the adding circuit, the decoded data to the second stress data to generate an updated accumulated stress data.

12. The method of claim 11, further comprising:

compressing, by the encoder, the updated accumulated stress data for storage in the memory.

13. The method of claim 11, wherein the generating the dither value is further based on a previous dither value corresponding to the first accumulated stress data, and wherein the previous dither value corresponds to a slice of a frame of pixel data different from a slice of the frame of pixel data corresponding to the second stress data.

14. The method of claim 9, wherein the first accumulated stress data corresponds to brightness values of a slice of a frame of pixel data to be displayed on a display device.

15. The method of claim 9, wherein the generating the dither value is further based on a previous dither value corresponding to the first accumulated stress data, and wherein the quantization value and the previous dither value are stored in a header of the compressed accumulated stress data.

16. The method of claim 9, wherein the generating the dither value comprises:

determining, by the decoder, the quantization value;

in response to determining that the quantization value is equal to 1, outputting, by the decoder, the dither value as zero; and in response to determining that the quantization value is equal to 2, outputting, by the decoder, the dither value as equaling a modulus of a previous dither value plus one and the quantization value.

17. The method of claim 9, wherein the generating the dither value comprises:

outputting, by the decoder, the dither value as equaling a modulus of a first value and the quantization value, wherein the first value is calculated as an addition of a previous dither value and half of the quantization value subtracted by one.

18. The method of claim 9, further comprising:

storing, by the decoder, the dither value in a header of the decoded data.

19. A system for performing stress compensation in a display device, the system comprising:

a memory; and a processing circuit configured to perform:

retrieving compressed stress data that is quantized by a quantization value;

decoding the compressed stress data to generate decoded data;

generating a dither value based on the quantization value of the compressed stress data; and adding the dither value to the decoded data to compensate for quantization of the compressed stress data.

20. The method of claim 1, wherein the adding the dither value comprises:

adding the dither value to the decoded data of all pixels in a slice of a frame of pixel data.

* * * * *